US008240787B2

(12) United States Patent
Chen et al.

(10) Patent No.: US 8,240,787 B2
(45) Date of Patent: Aug. 14, 2012

(54) SELF-CLOSING RAIL SYSTEM

(75) Inventors: Ken-Ching Chen, Kaohsiung Hsien (TW); Ting-Tsai Huang, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 296 days.

(21) Appl. No.: 12/618,807

(22) Filed: Nov. 16, 2009

(65) Prior Publication Data

US 2010/0123378 A1 May 20, 2010

(30) Foreign Application Priority Data

Nov. 20, 2008 (TW) ..... 97145018 A

(51) Int. Cl.
*A47B 95/00* (2006.01)
*A47B 95/02* (2006.01)

(52) U.S. Cl. ..... 312/333; 312/319.1

(58) Field of Classification Search .... 312/319.1–319.2, 312/333, 334.44, 334.46–334.47; 384/21
See application file for complete search history.

(56) References Cited

U.S. PATENT DOCUMENTS

| | | | | |
|---|---|---|---|---|
| 5,207,781 | A | 5/1993 | Rock | |
| 5,240,318 | A | 8/1993 | Schroder et al. | |
| 5,302,016 | A | 4/1994 | Lautenschlager et al. | |
| 5,316,389 | A * | 5/1994 | Hoffman | 384/18 |
| 5,364,179 | A | 11/1994 | Brustle et al. | |
| 5,474,375 | A * | 12/1995 | Hollenstein et al. | 312/319.1 |
| 5,490,724 | A * | 2/1996 | Domenig | 312/334.45 |
| 5,580,138 | A | 12/1996 | Grabher | |
| 6,244,678 | B1 * | 6/2001 | Dopp et al. | 312/333 |
| 6,375,290 | B1 * | 4/2002 | Lin et al. | 312/334.46 |
| 6,736,471 | B2 * | 5/2004 | Lin | 312/333 |
| 6,979,066 | B2 * | 12/2005 | Yang | 312/333 |
| 7,077,487 | B2 * | 7/2006 | Yang | 312/333 |
| 7,249,813 | B2 | 7/2007 | Gasser | |
| 7,441,848 | B2 | 10/2008 | Chen et al. | |
| 2003/0042831 | A1 * | 3/2003 | Le et al. | 312/334.44 |
| 2004/0227438 | A1 | 11/2004 | Tseng et al. | |
| 2005/0180667 | A1 * | 8/2005 | Chen et al. | 384/21 |
| 2007/0046159 | A1 * | 3/2007 | Hoffman | 312/333 |
| 2008/0197759 | A1 | 8/2008 | Chen et al. | |
| 2008/0265730 | A1 * | 10/2008 | Huang | 312/333 |
| 2009/0278430 | A1 * | 11/2009 | Liang et al. | 312/319.1 |
| 2011/0042446 | A1 * | 2/2011 | Liang et al. | 228/196 |
| 2011/0215690 | A1 * | 9/2011 | Juan et al. | 312/319.1 |

FOREIGN PATENT DOCUMENTS

| | | | |
|---|---|---|---|
| WO | WO 2004098350 | A1 * | 11/2004 |
| WO | WO 2006066774 | A1 * | 6/2006 |

* cited by examiner

*Primary Examiner* — Darnell Jayne
*Assistant Examiner* — Andrew Roersma
(74) *Attorney, Agent, or Firm* — Rosenberg, Klein & Lee

(57) ABSTRACT

A self-closing rail system includes a first rail, a second rail which is slidably connected to the first rail, and a self-closing device. The self-closing device includes an attachment member connected to the first rail and a guide portion extends longitudinally from the attachment member. A movable member is movably connected to the guide portion of the attachment member. An elastic member is connected between the attachment member and the movable member such that the elastic member applies a force to the movable member. A fixing member is connected to the second rail and has a pin which is connected to or disengaged from the movable member depending on the relative movement between the first and second rails.

12 Claims, 13 Drawing Sheets

SELF-CLOSING RAIL SYSTEM

FIELD OF THE INVENTION

The present invention relates to a self-closing rail system, and more particularly, to a self-closing device that is easily connected to and disengaged from the rail system.

BACKGROUND OF THE INVENTION

A conventional self-closing device for a rail system is disclosed in U.S. Pat. No. 5,490,724 to Domenig, titled "Drawer guide for supporting a movable structure such as a drawer in a furniture article", and the device discloses a rail system for slidably supporting a movable structure such as a drawer on a furniture article. The device includes a rotatable roller on a guide rail which is substantially horizontally connected to the furniture article and a movable rail which supports the movable structure. The movable rail is able to move relative to the guide rail, wherein the distal end of the guide rail has a tilt surface which is located lower than the horizontal surface so that when the movable rail moves inward to the tilt surface, the movable rail is guided by the tilt surface and retracted in the furniture article.

It is noted that the movable rail has to be retracted until the movable rail moves to the tilt surface of the distal end of the guide rail. The movable rail cannot be automatically guided to be retracted. The distance of the tilt surface usually is limited and the movable rail traveling this short distance cannot have an automatic return function. Besides, the rail system returns the movable rail by the gravity which is deemed to be not sufficient.

SUMMARY OF THE INVENTION

The present invention intends to provide a self-closing device for a rail system which can assist the movable rail to automatically return.

The present invention relates to a self-closing rail system and comprises a first rail, a second rail and a self-closing device. The first rail has a first wall, a second wall and a third wall which is connected between the first and second walls. A first channel is defined among the first, second and third walls. The second rail is slidably connected to the first rail. The self-closing device includes an attachment member which is connected to the first rail. The attachment member includes a guide portion which extends longitudinally from the attachment member. The guide portion includes a first guide end and a second guide end opposite to the first guide end. A movable member is movably connected to the guide portion of the attachment member. An elastic member is connected between the attachment member and the movable member such that the elastic member applies a force to the movable member. A fixing member is connected to the second rail and a pin is connected to the fixing member. The movable member is located at the first guide end of the guide portion and the pin is engaged with the movable member when the first and second rails are retracted. The movable member is moved when the second rail moves away from the first rail. The movable member is moved to the second guide end of the guide portion to generate an angular movement when the second rail is moved relative to the first rail to a predetermined position. In this status, the second rail can be freely pulled away from the first rail without restriction of the elastic member. The second rail is contact with the movable member when the second rail is retracted relative to the first rail. The movable member is removed and the force of the elastic member retracts the second rail toward the first rail.

Preferably, the first rail includes a first end and a second end. A first assist member is pivotably connected to the first end of the first rail. The second rail includes a first wall, a second wall and a third wall which is connected between the first and second walls of the second rail. A second channel is defined among the first, second and third walls of the second rail. The second rail has a first end and a second end. The first assist member is rotatably supported by the second channel which is located corresponding to the first channel. A second assist member is pivotably connected to the second end of the second rail and rotatably supported by the first channel of the first rail.

Preferably, the first and second walls on the second end of the first rail respectively have a first tilt surface. The second channel of the second rail has a second tilt surface close to the first end of the second rail. The second tilt surface is located corresponding to the first tilt surface of the first rail.

Preferably, the attachment member includes a first side which is located corresponding to the third wall of the first rail. A first plate extends from the first side of the attachment member and is located corresponding to the second wall of the first rail. The first plate has a first stop wall extends upward from a side thereof. A second plate extends from the first side of the attachment member and is located corresponding to the first wall of the first rail. The second plate has a second stop wall extends downward from a side thereof. A third plate extends from the first side of the attachment member and is connected to the first rail.

Preferably, the first rail includes a first connection portion which is located corresponding to the third plate of the attachment member. The third plate includes a flexible leg corresponding to the first connection portion of the first rail and a first stop is located at a distance from the flexible leg. A second stop extends from the first side of the attachment member. An engaging space is defined among the flexible leg, the first stop and the second stop. The engaging space substantially has the same length as that of the first connection portion of the first rail.

Preferably, the first rail includes a first connection part which is located corresponding to the third plate on the attachment member. The third plate is a protrusion and the first connection part is a hole with which the third plate is engaged.

Preferably, the movable member includes a first support, a second support and a third support. A passage is defined among the first, second and third supports and the guide portion is engaged with the passage.

Preferably, a buffering member is fixed to the attachment member and includes a retractable rod to be contact with the movable member.

Preferably, the first and second walls of the second end of the first rail respectively include a first tilt surface. The second channel of the second rail has a second tilt surface close to the first end of the second rail. The second tilt surface is located corresponding to the first tilt surface of the first rail. The guide portion is located corresponding to the first and second tilt surfaces and includes an angle relative to a horizontal plane.

Preferably, the second rail includes a second connection portion which is a hole and the fixing member includes a first fixing portion and a second fixing portion. The first fixing portion is connected to the second connection portion of the second rail and the second fixing portion is connected to the second rail.

Preferably, the movable member includes a reception portion with which the pin is engaged. An elastic portion is located at a first end of the reception portion and an anchoring portion is located at a second end of the reception portion so as to be connected with an end of the elastic member.

Preferably, the attachment member of the self-closing device includes a first hole, a second hole and a protrusion. The third wall of the first rail includes a first protruding plate and a second protruding plate. The first and second protruding plates are engaged with the first and second hole. The third wall of the first rail includes an aperture with which the protrusion is engaged, such that the first and second protruding plates are secured with the first and second holes.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1:
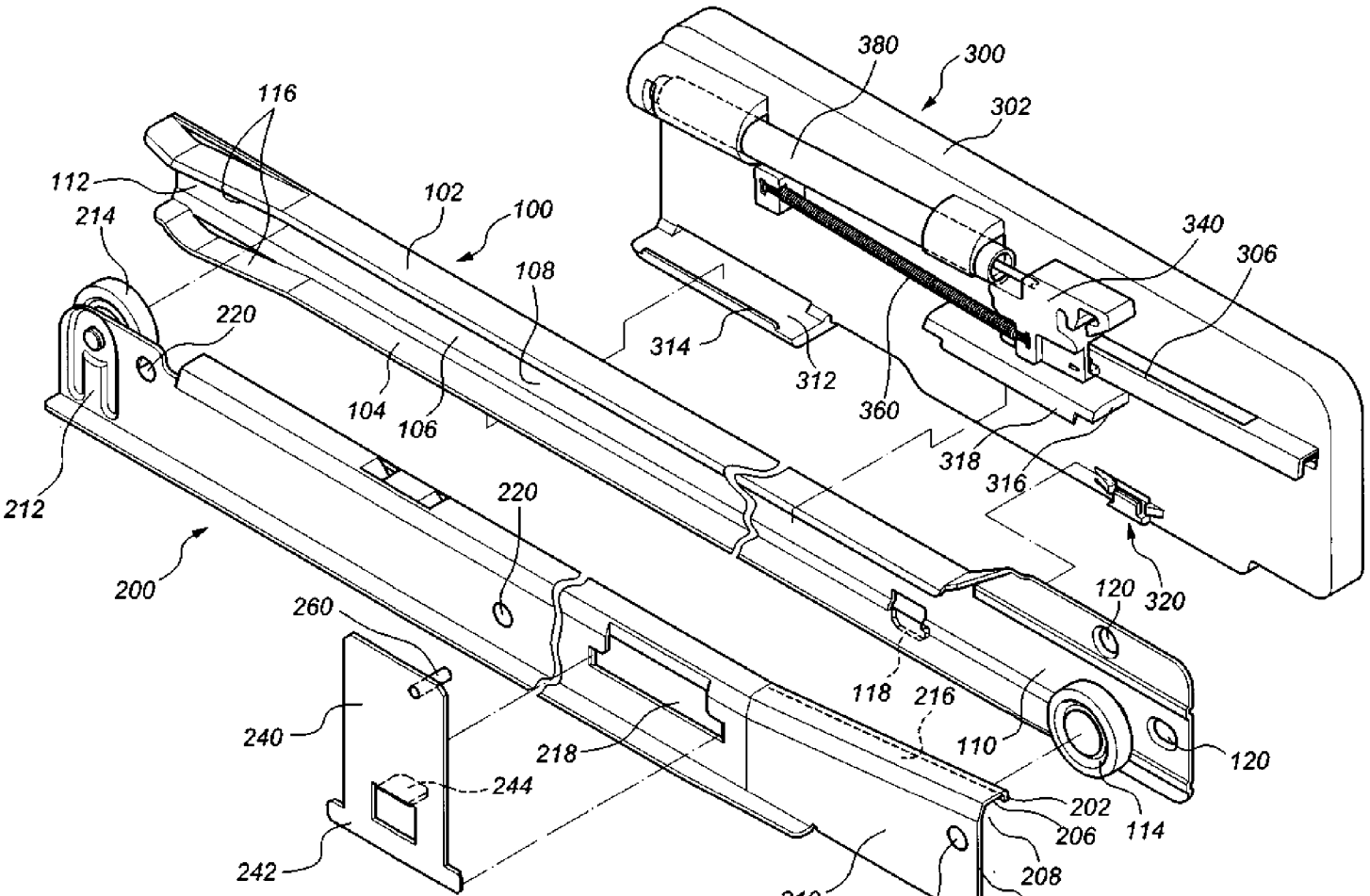
FIG. 1 is an exploded view according to a first embodiment of the present invention.

Referring to FIG. 1, a self-closing rail system according to a first embodiment of the present invention comprises a first rail 100, a second rail 200, a fixing member 240, a pin 260, and a self-closing device 300.

The first rail 100 has a first wall 102, a second wall 104 and a third wall 106 which is connected between the first and second walls 102, 104. A first channel 108 is defined among the first, second and third walls 102, 104 and 106. The first rail 100 includes a first end 110 and a second end 112 opposite to the first end 110. A first assist member 114 is pivotally connected to the first end 110 of the first rail 100, wherein, as mentioned in the prior art (such as U.S. Pat. No. 5,490,724), the first and second walls 102, 104 of the second end 112 of the first rail 100 respectively include a first tilt surface 116. In this embodiment, the first assist member 114 is a roller. The first rail 100 further includes a first connection portion 118 and a plurality of holes 120 thereon.

The second rail 200 is slidably connected to the first channel 108 of the first rail 100. The second rail 200 includes a first wall 202, a second wall 204 and a third wall 206 which is connected between the first and second walls 202, 204 of the second rail 200. A second channel 208 is defined among the first, second and third walls 202, 204 and 206 of the second rail 200. The second rail 200 has a first end 210 and a second end 212 opposite to the first end 210. The first assist member 114 is rotatably supported by the second channel 208 which is located corresponding to the first channel 108. A second assist member 214 is pivotably connected to the second end 212 of the second rail 200 and rotatably supported by the first channel 108 of the first rail 100. The second channel 208 of the second rail 200 has a second tilt surface 216 close to the first end 210 of the second rail 200. The second tilt surface 216 is located corresponding to the first tilt surface 116 of the first rail 100, such that the first and second rails 100, 200 are maintained substantially to be horizontal when the second rail 200 is retracted relative to the first rail 100. In this embodiment, the second assist member 214 is a roller. The second rail 200 further includes a second connection portion 218 located on the second wall 204 of the second rail 200 and a plurality of holes 220 thereon.

Figure 2:
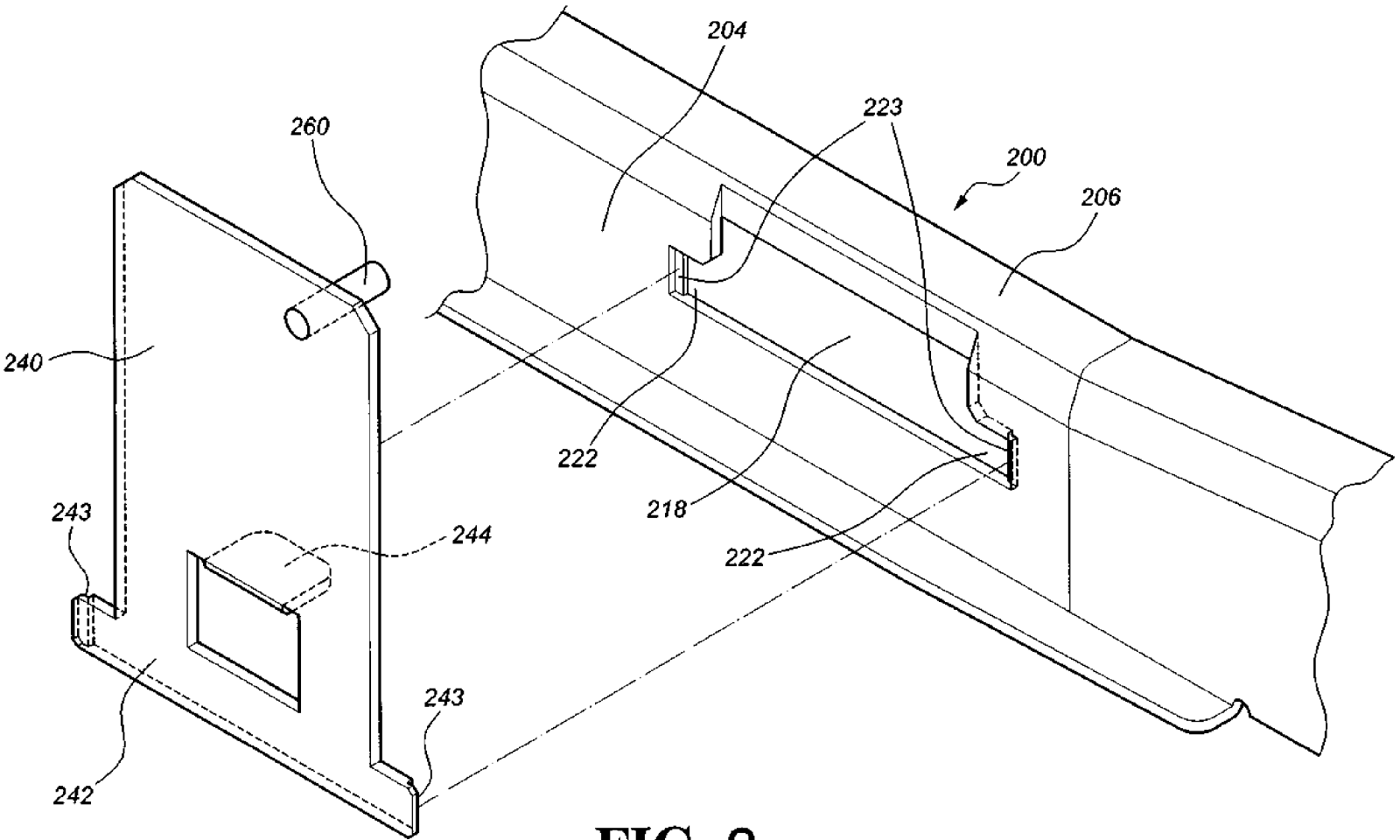
FIG. 2 is an enlarged view showing a fixing member and a second rail according to the first embodiment of the present invention.
Figure 3:
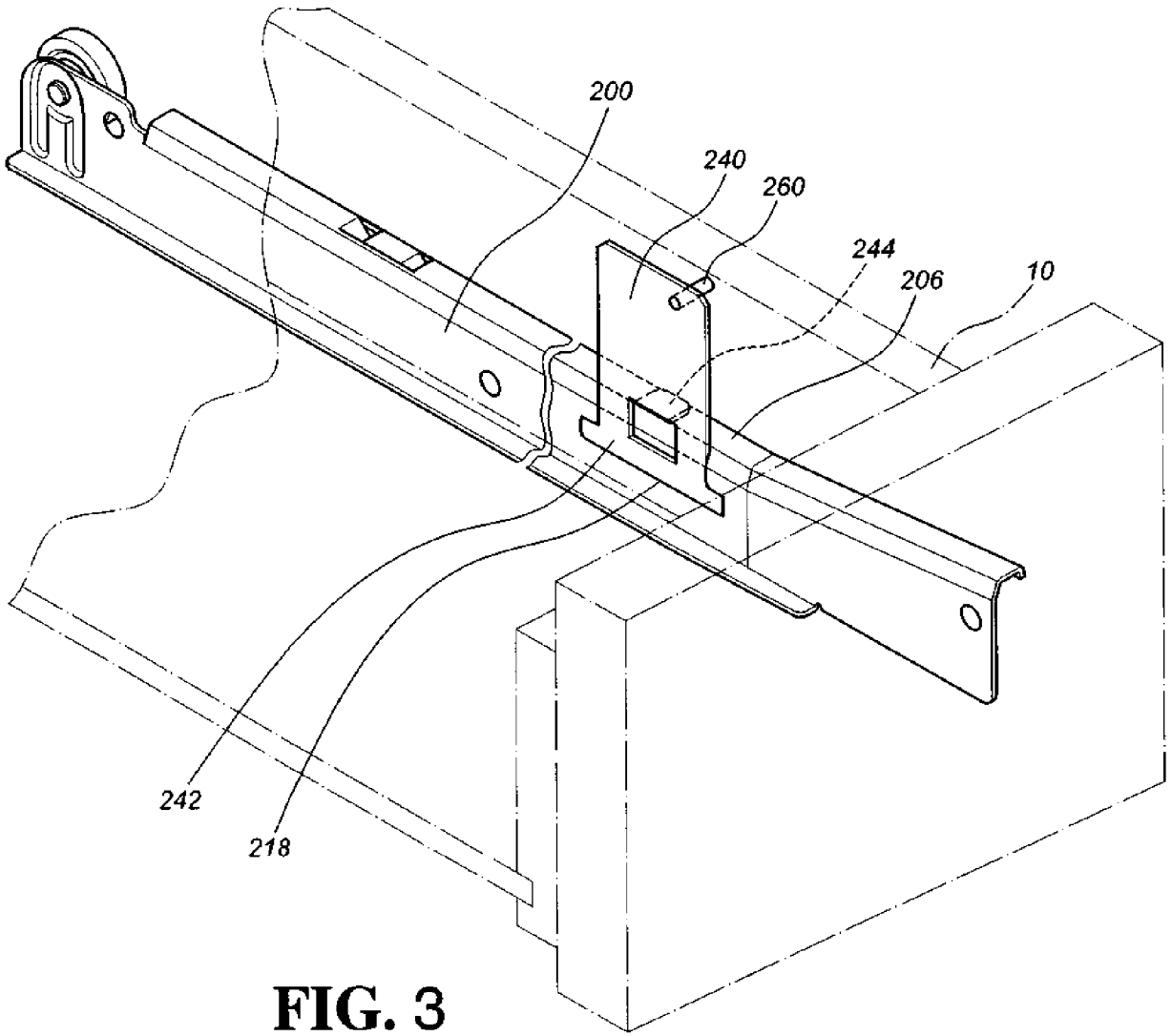
FIG. 3 is a perspective view showing the fixing member and the second rail connected with a drawer according to the first embodiment of the present invention.

The fixing member 240 is connected to the second rail 200. Referring to FIG. 2, the fixing member 240 includes a first fixing portion 242 and a second fixing portion 244. The first fixing portion 242 is located corresponding to the second connection portion 218 of the second rail 200. The second fixing portion 244 is formed on the fixing member 240 and located corresponding to the third wall 206 of the second rail 200. In this embodiment, the second connection portion 218 is a connection hole formed on the second wall 204 of the second rail 200. The second connection portion 218 may include one or a pair of transverse holes 222 on the second wall 204. The first fixing portion 242 of the fixing member 240 can be connected to the second connection portion 218 of the second rail 200. The second fixing portion 244 can be in contact with the third wall 206 of the second rail 200 such that the connection is well positioned from top to bottom. Besides, the first fixing portion 242 includes stepped engaging portions 243 and the transverse holes 222 of the second connection portion 218 include two tabs 223 to which the stepped engaging portions 243 are connected. As shown in FIG. 3, the first fixing portion 242 of the fixing member 240 is connected to the second connection portion 218 of the second rail 200, and the second fixing portion 244 is contact with the third wall 206 of the second rail 200. When a drawer 10 is connected to the rail system, the fixing member 240 is firmly connected between the second rail 200 and the drawer 10. Alternatively, the fixing member 240 can be welded to the second rail 200.

The pin 260 is connected to the fixing member 240.

Figures 4, 5:
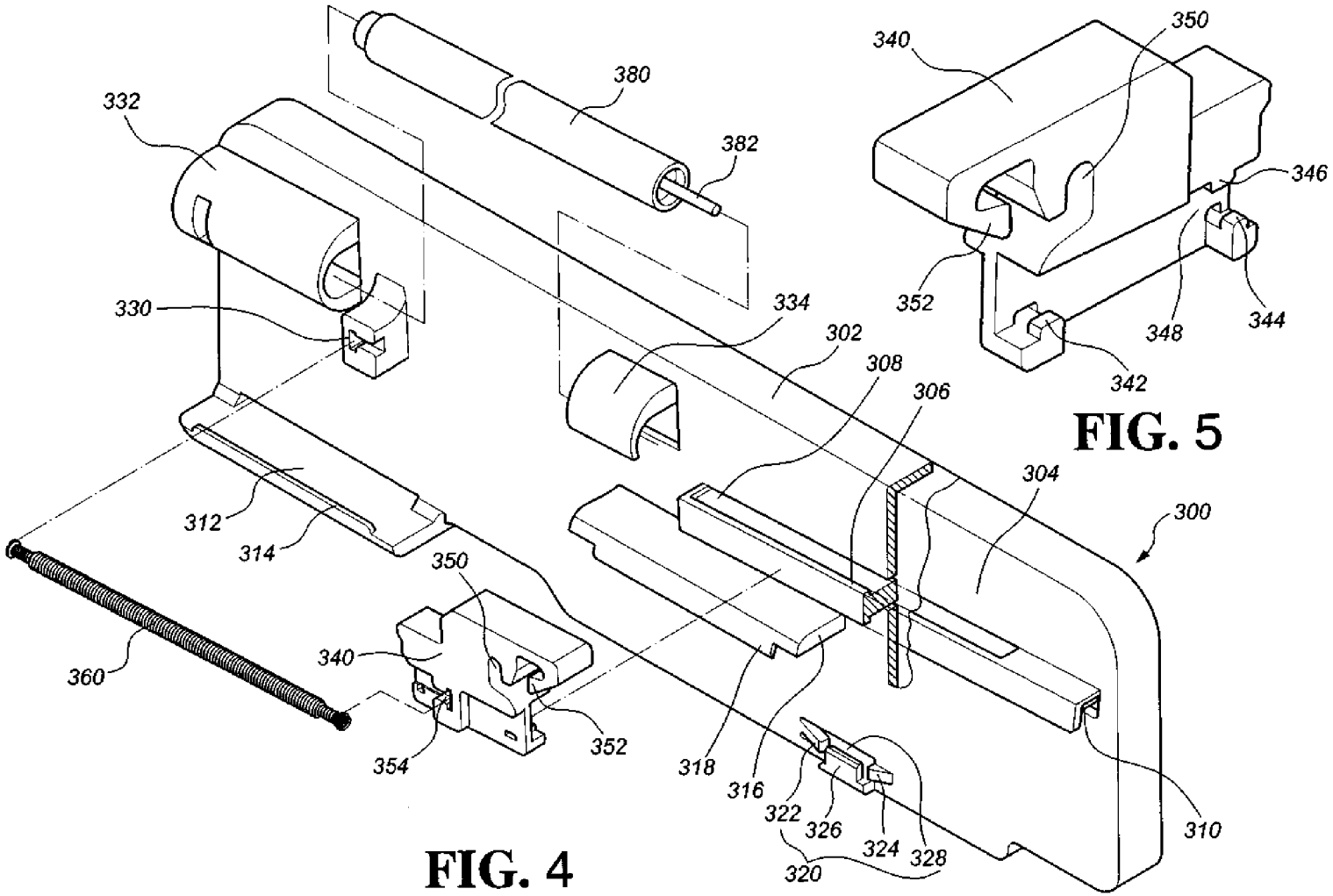
FIG. 4 is an exploded view showing a self-closing device according to the first embodiment of the present invention.
FIG. 5 is a perspective view showing a movable member of the self-closing device according to the first embodiment of the present invention.

The self-closing device 300 is connected to the first rail 100. Referring to FIG. 4, the self-closing device 300 includes an attachment member 302, a movable member 340, an elastic member 360, and a buffering member 380.

Figure 9:
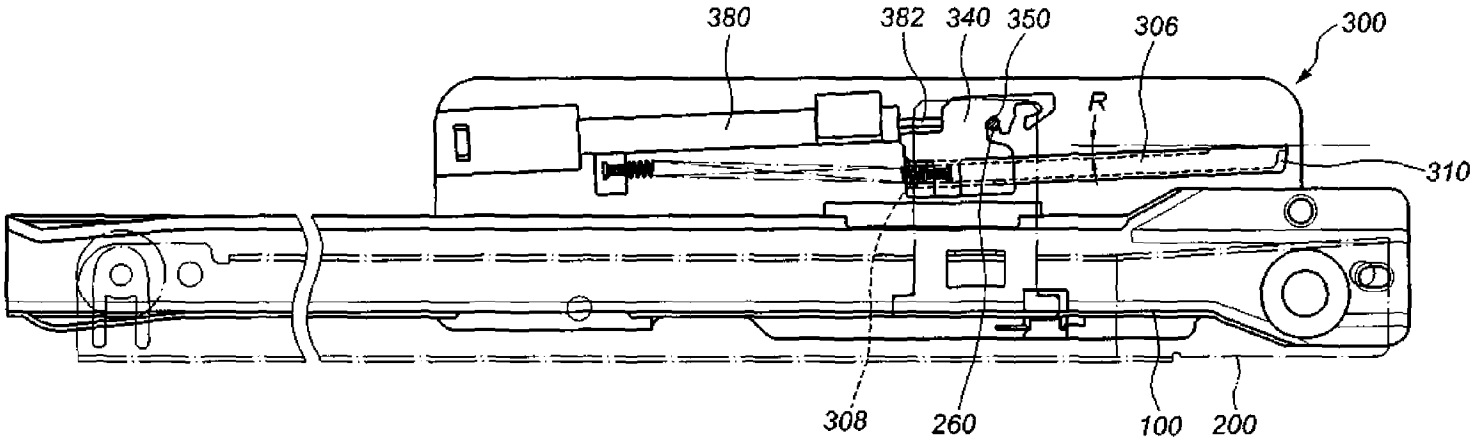
FIG. 9 is a schematic view showing that the second rail is retracted relative to the first rail according to the first embodiment of the present invention.

The attachment member 302 is connected to the first rail 100. The attachment member 302 includes a first side 304 which is located corresponding to the third wall 106 of the first rail 100. A guide portion 306 extends longitudinally from the first side 304. The guide portion 306 includes a first guide end 308 and a second guide end 310 opposite to the first guide end 308. The second rail 200 has the second tilt surface 216 on the first end 210 of the second channel 208. The second tilt surface 216 is located corresponding to the first tilt surface 116 of the first rail 100. The guide portion 306 is located corresponding to the first and second tilt surfaces 116, 216 and includes an angle "R" relative to a horizontal plane, as shown in FIG. 9. The attachment member 302 includes a first plate 312 which extends from the first side 304 of the attachment member 302 and is located corresponding to the second wall 104 of the first rail 100. The first plate 312 has a first stop wall 314 which extends upward from a side thereof so as to restrict the second wall 104 of the first rail 100 from movement relative to the first stop wall 134. A second plate 316 extends from the first side 304 of the attachment member 302 and is located corresponding to the first wall 102 of the first rail 100. The second plate 316 has a second stop wall 318 extends downward from a side thereof so as to restrict the first wall 102 of the first rail 100 from movement relative to the second stop wall 318. A third plate 320 extends from the first side 304 of the attachment member 302 and is located corresponding to the first connection portion 118 of the first rail 100. The third plate 320 extends from the first side 304 of the attachment member 302 and includes a flexible leg 322 corresponding to the first connection portion 118 of the first rail 100. A first stop 324 is located at a distance from the flexible leg 322. A second stop 326 extends from the first side 304 of the attachment member 302. An engaging space 328 is defined among the flexible leg 322, the first stop 324 and the second stop 326. The engaging space 328 substantially has the same length as that of the first connection portion 118 of the first rail 100. The attachment member 302 includes first, second and third connection parts 330, 332 and 334.

The movable member 340 is movably connected to the guide portion 306 of the attachment member 302. As shown in FIG. 5, the movable member 340 includes first, second and third supports 342, 344 and 346 and a passage 348 defined among the first, second and third supports 342, 344 and 346 for engaging with the guide portion 306 of the attachment member 302. The movable member 340 includes a reception portion 350 with which the pin 260 is engaged, as shown in FIG. 9. An elastic portion 352 is located at a first end of the reception portion 350, and an anchoring portion 354 is located at a second end of the reception portion 350 so as to be connected with an end of the elastic member 360.

The elastic member 360 is connected between the attachment member 302 and the movable member 340. The elastic member 360 has one end connected to the anchoring portion 354 of the movable member 340, and the other end of the elastic member 360 is connected to the first connection part 330 of the attachment member 302 such that the elastic member 360 applies a force to the movable member 340.

The buffering member 380 is selectively adopted and fixed to the attachment member 302. In this embodiment, the buffering member 380 is connected to the second and third connection parts 332, 334. The buffering member 380 includes a retractable rod 382 which is retractably contact with the movable member 340 so as to buffer the movable member 340.

Figure 6:
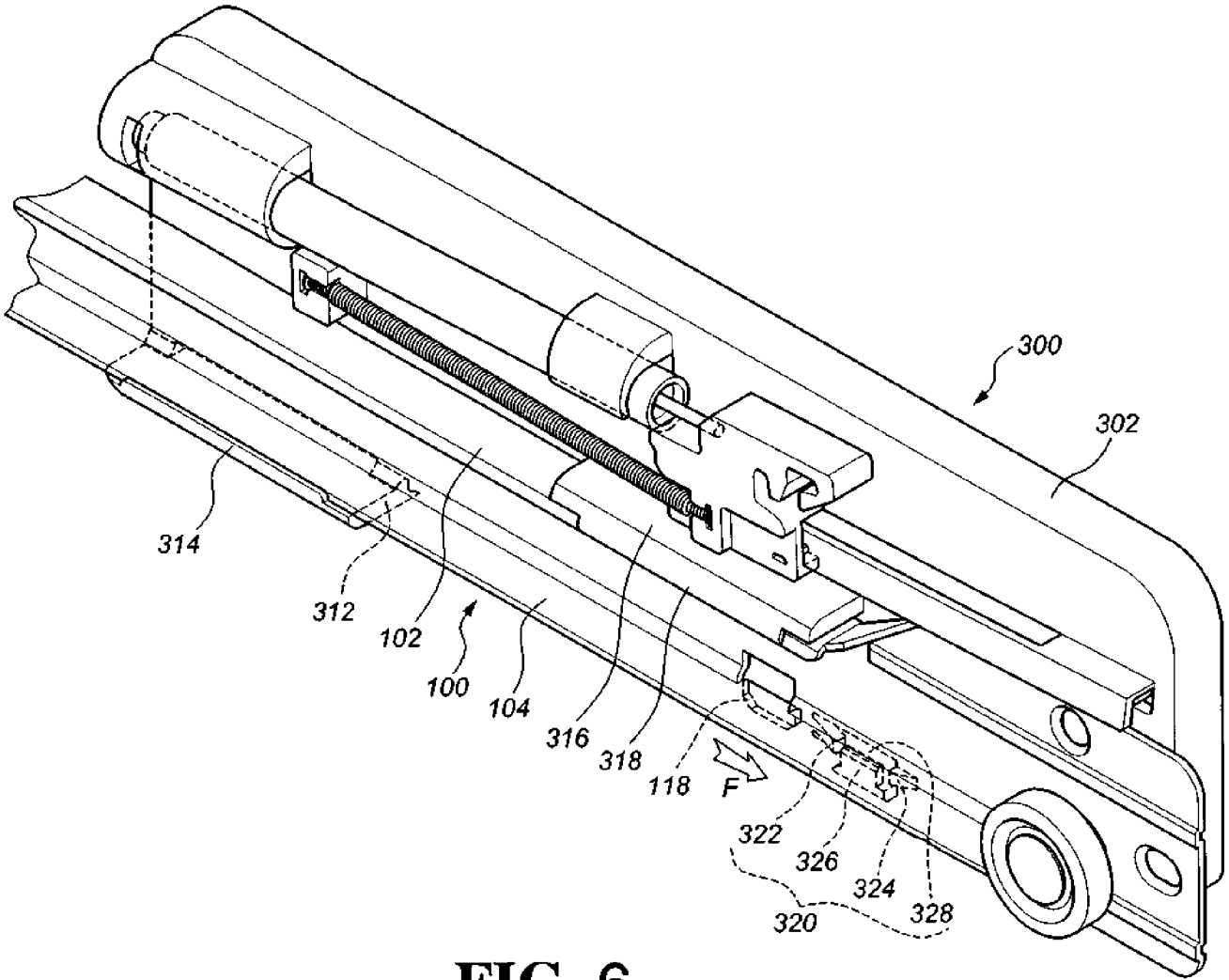
FIG. 6 is a schematic view showing the self-closing device connected with a first rail according to the first embodiment of the present invention.
Figure 7:
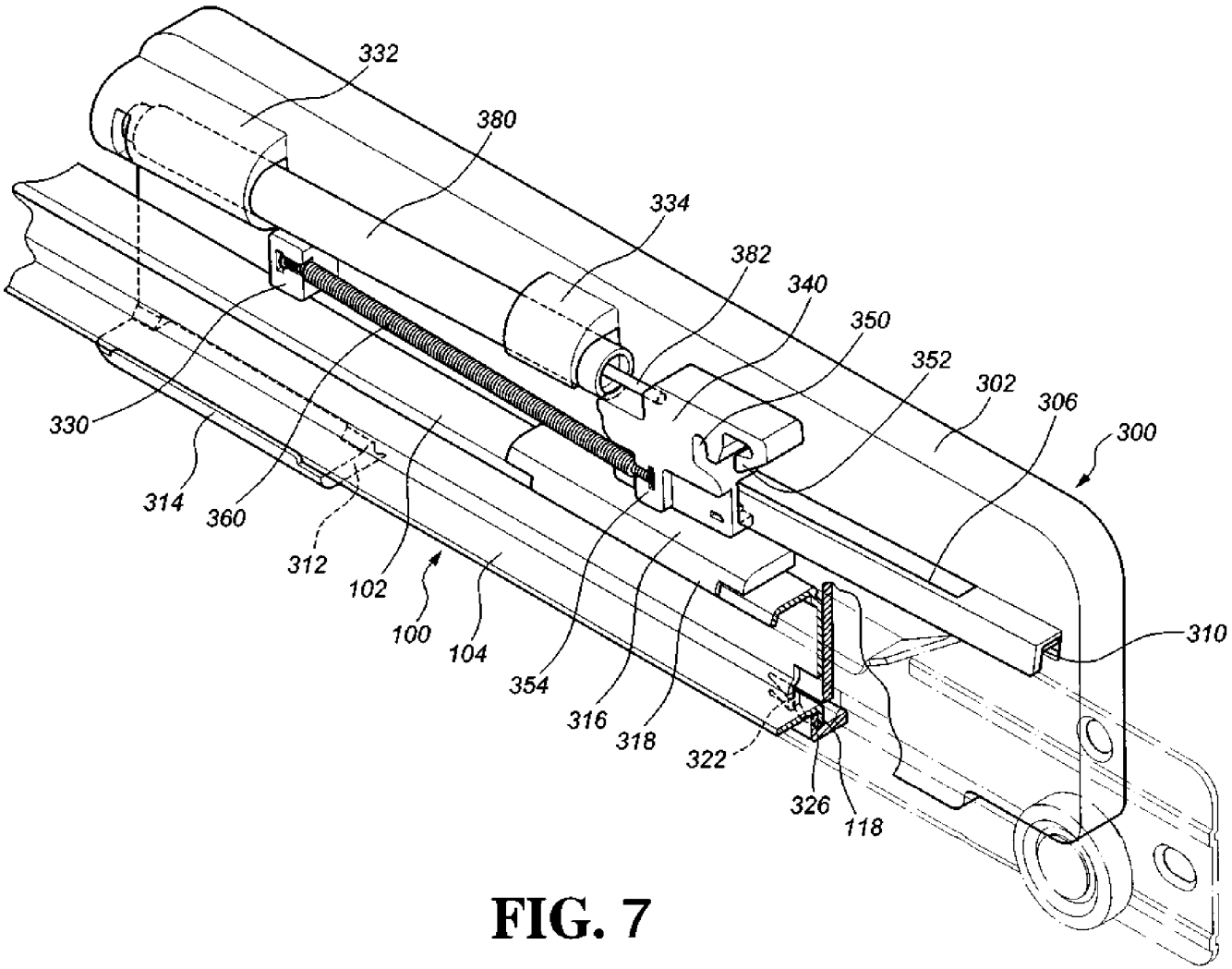
FIG. 7 is another schematic view showing the self-closing device connected with the first rail according to the first embodiment of the present invention.

Referring to FIGS. 6 and 7, the self-closing device 300 is connected to the first rail 1. In this embodiment, the self-closing device 300 and the first plate 312 are connected to the second wall 104 of the first rail 100 by the attachment member 302, and the first stop wall 314 is engaged with the edge of the second wall 104. The second plate 316 is connected to the first wall 102 of the first rail 100, and the second stop wall 318 is engaged with the edge of the first wall 102 such that the self-closing device 300 clamps the first rail 100. The first rail 100 is shifted in the direction designated by the arrow head "F" relative to the self-closing device 300 to move the first connection portion 118 of the first rail 100 over the flexible leg 322 until the first connection portion 118 is engaged with the engaging space 328 and is stopped by the first stop 324. The flexible leg 322 bounces back and is contact with the first connection portion 118 so that the first connection portion 118 is engaged with the third plate 320 of the attachment member 302. The self-closing device 300 is then fixed to the first rail 100.

Figure 8:
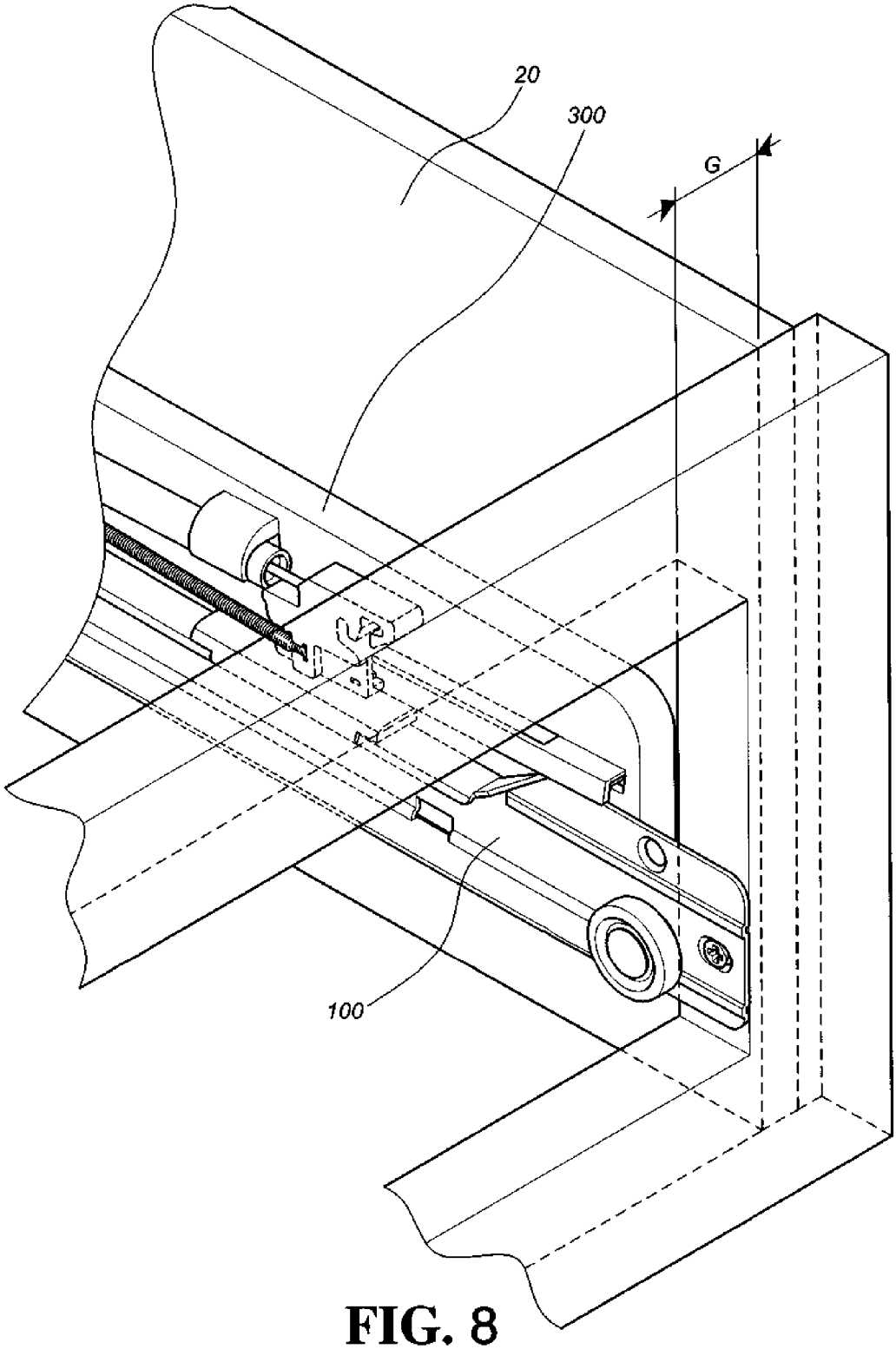
FIG. 8 is a schematic view showing the first rail connected to a furniture article according to the first embodiment of the present invention.

Referring to FIG. 8, when the first rail 100 is connected to a furniture article 20, a gap "G" is defined between the first rail 100 and the furniture article 20. The self-closing device 300 is connected to the third wall 106 of the first rail 100 and located in the gap "G". As shown in FIG. 3, the furniture article 20 is cooperated with the drawer 10, and the second rail 200 is slidably connected to the first rail 100 so that the drawer 10 can be pulled out or retracted into the furniture article 20.

Figure 10:
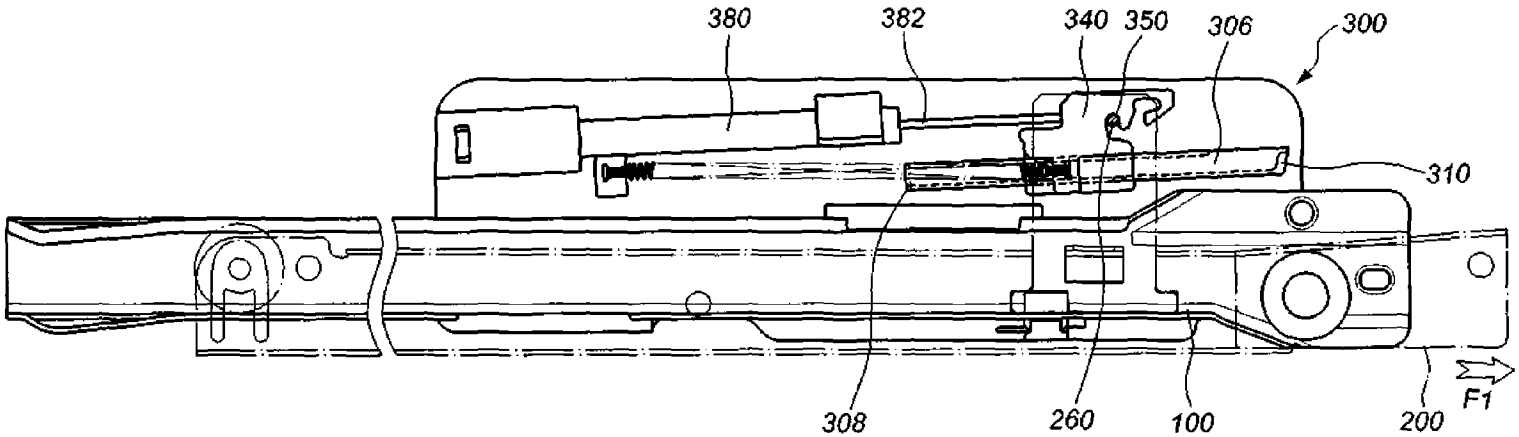
FIG. 10 is a schematic view showing that the second rail is pulled away from the first rail according to the first embodiment of the present invention.
Figure 11:
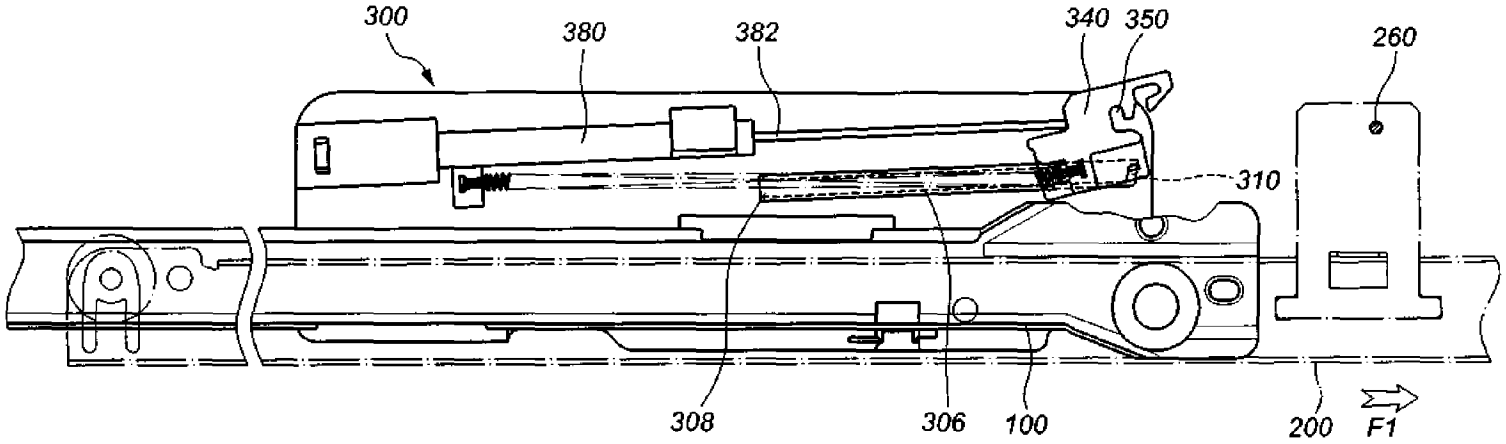
FIG. 11 is a schematic view showing the movable member in an engaged status when the second rail is pulled away from the first rail according to the first embodiment of the present invention.

Referring to FIG. 9, when the first and second rails 100, 200 are in a retracted status, the pin 260 of the second rail 200 is engaged with the reception portion 350 of the movable member 340 of the self-closing device 300, and the movable member 340 is located at the first guide end 308 of the guide portion 306. The retractable rod 382 of the buffering member 380 is contact with the movable member 340. When the second rail 200 is moved toward the direction "F1" relative to the first rail 100, as shown in FIG. 10, the movable member 340 is driven by the second rail 200 to move along the guide portion 306. The retractable rod 382 extends toward the movable member 340. When the second rail 200 is moved to a predetermined position relative to the first rail 100, the fixing member 240 and the pin 260 are moved over the first end 110 of the first rail 100, and the movable member 340 is brought to the second guide end 310 of the guide portion 306 to generate an angular movement, so that the pin 260 is disengaged from the movable member 340 and the force of the elastic member 360 maintains the movable member 340 at the position. As shown in FIG. 11, in this status, the second rail 200 can be freely pulled away from the first rail 100 without restriction of the elastic member 360.

Figure 12:
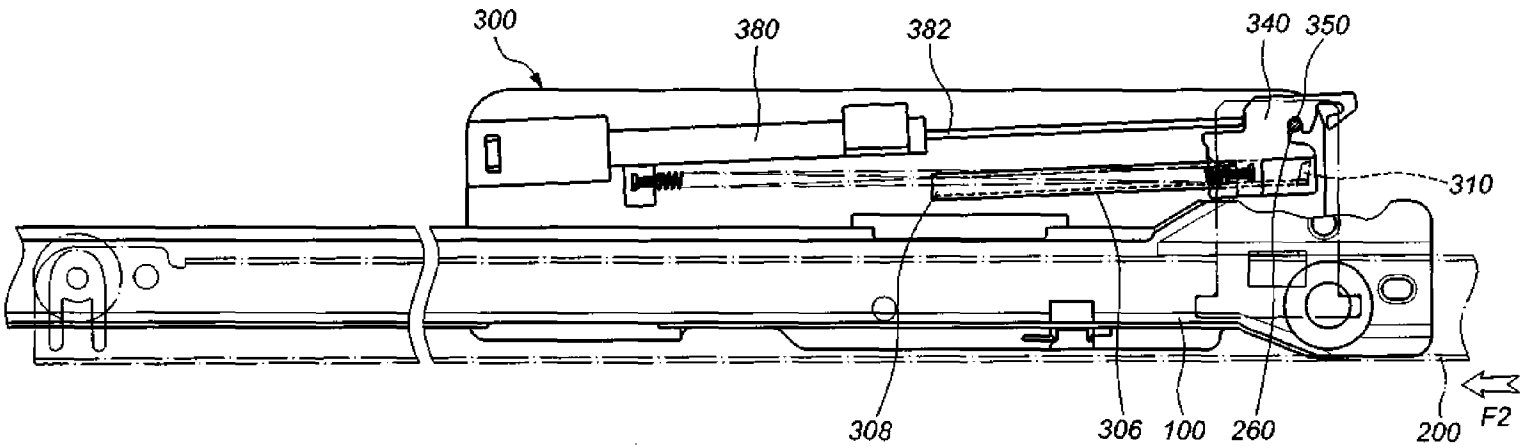
FIG. 12 is a schematic view showing that the second rail is retracted toward the first rail according to the first embodiment of the present invention.

When the second rail 200 is retracted toward the direction "F2" relative to the first rail 100, as shown in FIG. 12, the pin 260 is engaged with the reception portion 350 of the movable member 340 again so that the movable member 340 returns from the pivoted position and the force of the elastic member 360 assists the second rail 200 to be retracted toward the first rail 100. The retractable rod 382 is contact with the movable member 340 so that the second rail 200 is moved smoothly and quietly relative to the first rail 100.

When the movable member 340 is moved along with the second rail 200, it returns to the first guide end 308 of the guide portion 306 by the force of the elastic member 360. This allows the second rail 200 to be retracted relative to the first rail 100. The pin 260 moves over the elastic portion 352 and is stopped at the end of the elastic portion 352. The second rail 200 is then able to be pulled relative to the first rail 100 and the movable member 340 is moved along the guide portion 306 of the attachment member 302 with the second rail 200. When the second rail 200 is moved to the predetermined position relative to the first rail 100, the movable member 340 is moved to the second guide end 310 of the guide portion 306 again and generates the angular movement. This removes the pin 260 from the movable member 340 and the movable member 340 is maintained in this status by the force of the elastic member 360. As shown in FIG. 11, the second rail 200 is freely movable relative to the first rail 100 without restriction of the force of the elastic member 360.

Figure 13:
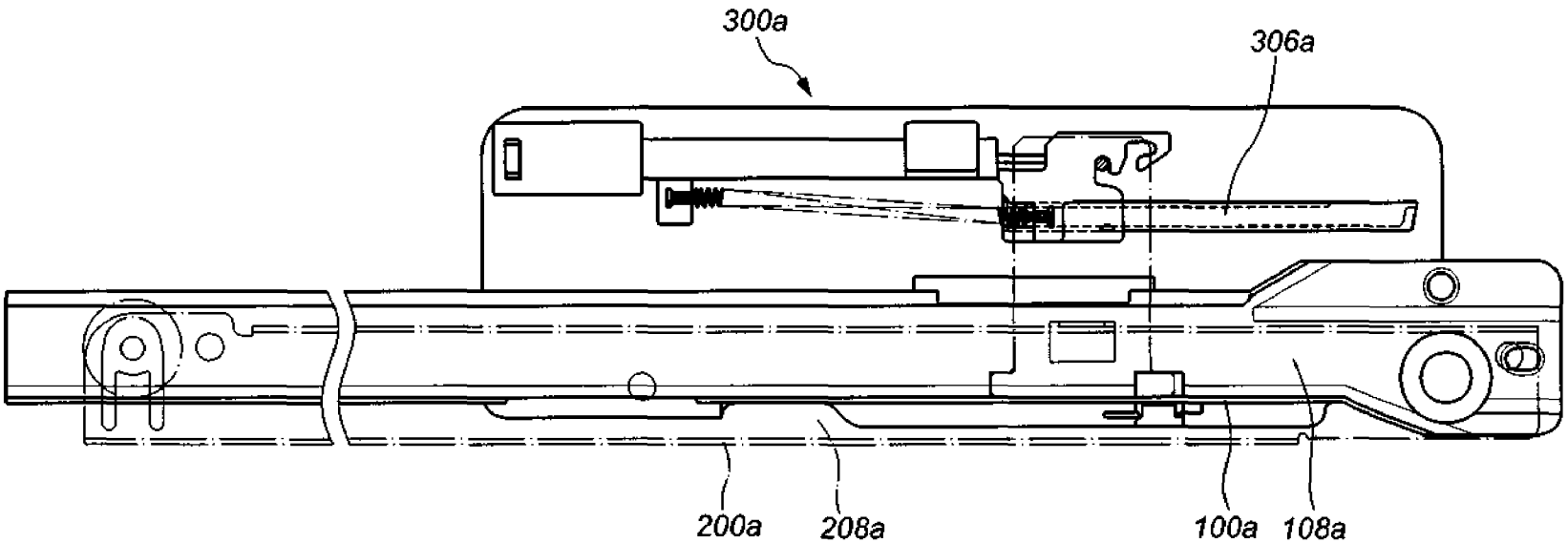
FIG. 13 is an assembled schematic view according to a second embodiment of the present invention.

FIG. 13 is a second embodiment of the present invention, which shows a rail system without the tilt surfaces, wherein the self-closing device 300*a* is connected to the first rail 100*a* and includes a guide portion 306*a*. The first rail 100*a* includes the first channel 108*a* and the second rail 200*a* includes the second channel 208*a*. In this embodiment, the guide portion 306*a*, the first channel 108*a* and the second channel 208*a* are substantially parallel to each other in a horizontal direction.

Figure 14:
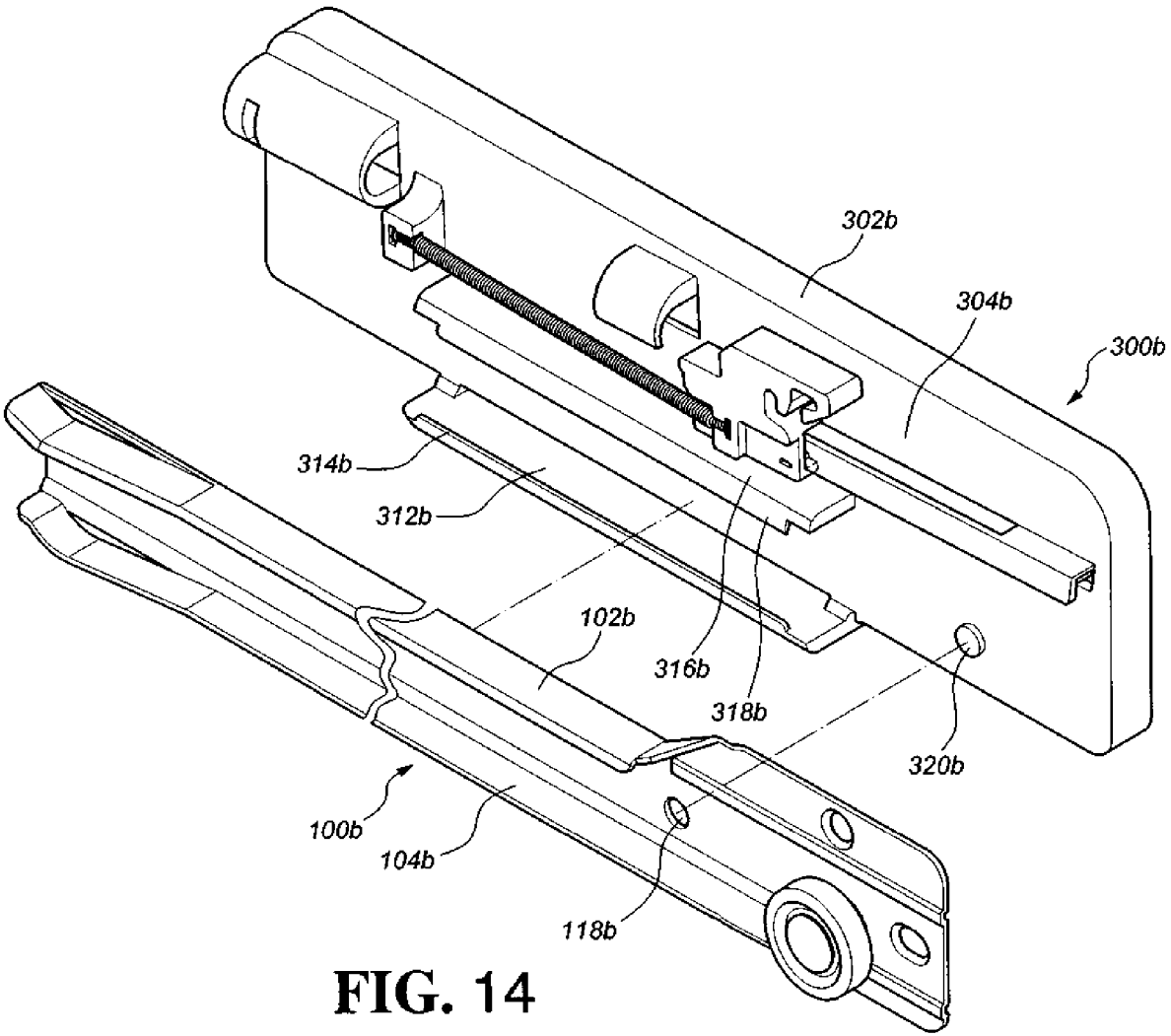
FIG. 14 is an exploded view showing the self-closing device and the first rail according to a third embodiment of the present invention.
Figure 15:
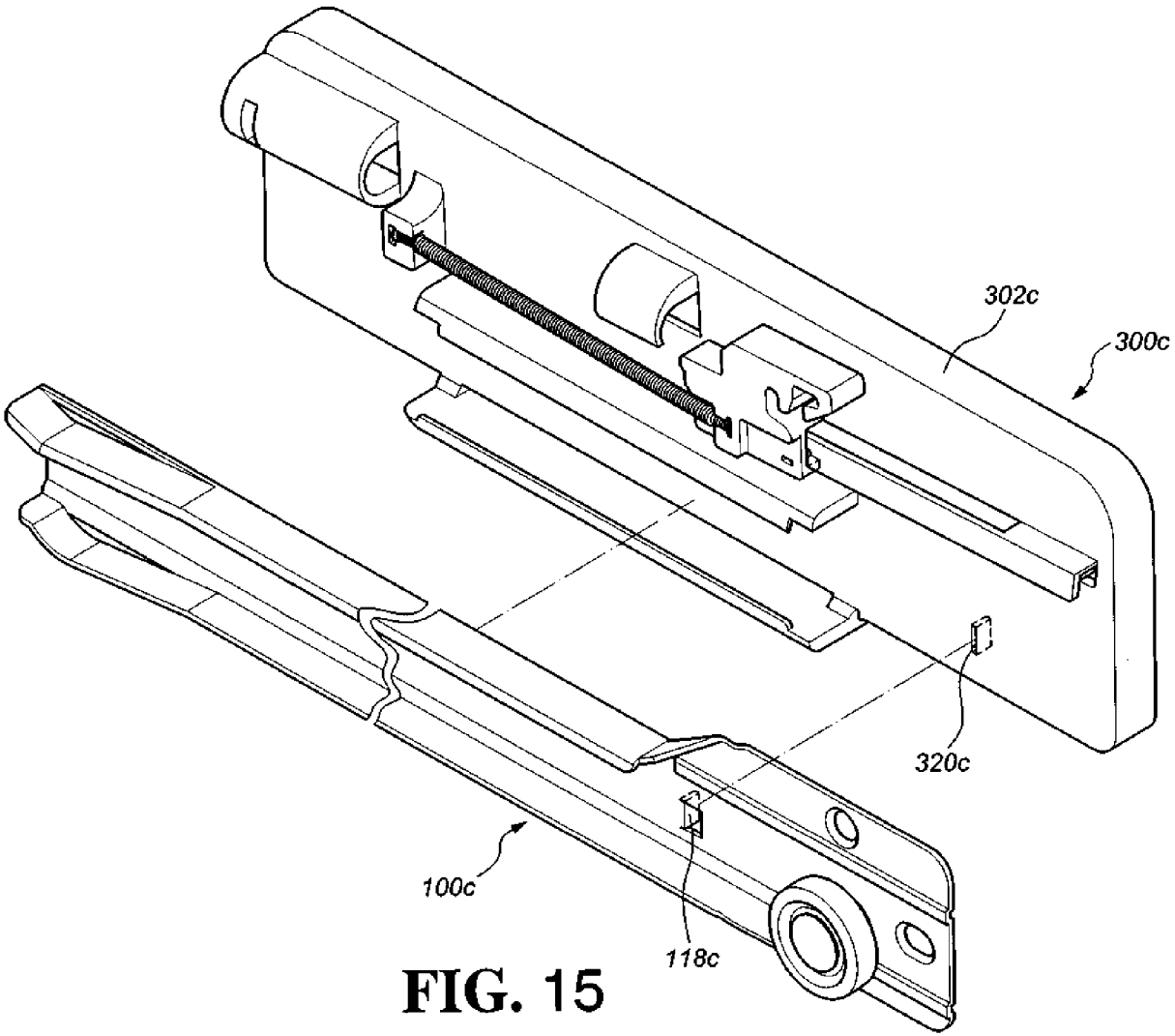
FIG. 15 is an exploded view showing the self-closing device and the first rail according to a fourth embodiment of the present invention.

FIG. 14 shows a third embodiment of the present invention, wherein the self-closing device 300*b* includes the first plate 312*b* which is located corresponding to the second wall 104*b* of the first rail 100*b*. The first plate 312*b* extends from the first side 304*b* of the attachment member 302*b*. The first stop wall 314*b* extends upward from a side of the first plate 312*b* so as to restrict the second wall 104*b* of the first rail 100*b* from movement relative to the first stop wall 314*b*. The second plate 316*b* is located corresponding to the first wall 102*b* of the first rail 100*b* and extends from the first side 304*b* of the attachment member 302*b*. The second stop wall 318*b* extends downward from a side of the second plate 316*b* so as to restrict the first wall 102*b* of the first rail 100*b* from movement relative to the second stop wall 3186. The third plate 320*b* is a protrusion and the first connection part 118*b* is a hole with which the third plate 320*b* is engaged, such that the self-closing device 300*b* is fixed to the first rail 100*b*. Alternatively, FIG. 15 shows a fourth embodiment of the present invention, wherein the third plate 320*c* on the attachment member 302*c* of the self-closing device 300*c* is a protrusion and the first connection part 118*c* of the first rail 100*c* is a hole with which the third plate 302*c* is engaged to connect the self-closing device 300*c* to the first rail 100*c*.

Figure 16:
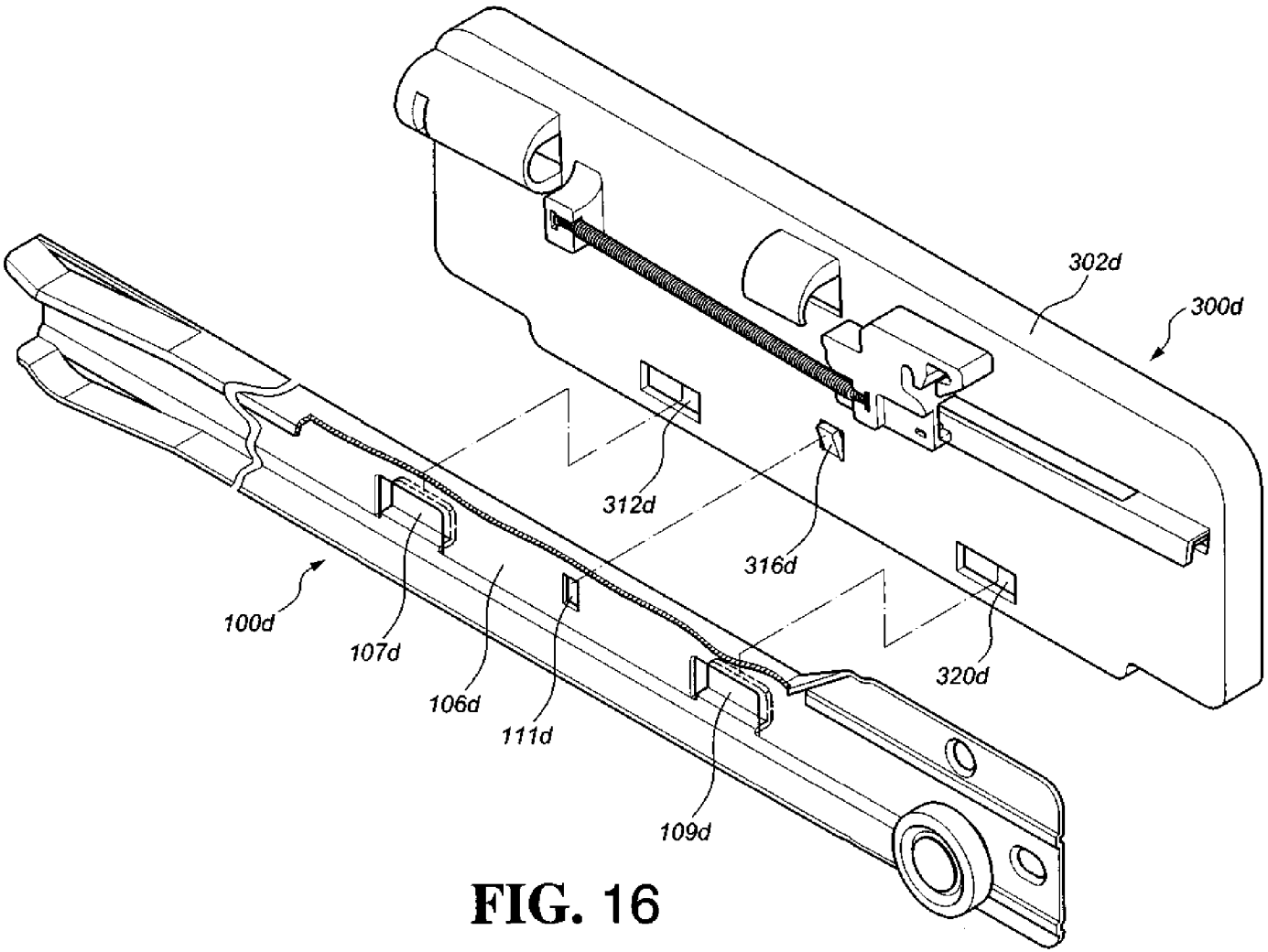
FIG. 16 is an exploded view showing the self-closing device and the first rail according to a fifth embodiment of the present invention.

FIG. 16 shows a fifth embodiment of the present invention, wherein the attachment member 302*d* of the self-closing device 300*d* includes a first hole 312*d*, a second hole 320*d* and a protrusion 316*d*. The third wall 106*d* of the first rail 100*d* includes a first protruding plate 107*d* and a second protruding plate 109*d*, the first and second protruding plates 107*d*, 109*d* are engaged with the first and second holes 312*d*, 320*d*. The third wall 106*d* of the first rail 100*d* includes an aperture 111*d* with which the protrusion 316*d* of the self-closing device 300*d* is engaged, such that the first and second protruding plates 107*d*, 109*d* are secured with the first and second holes 312*d*, 320*d* to firmly connect the self-closing device 300*d* to the first rail 100*d*.

While we have shown and described the embodiment in accordance with the present invention, it should be clear to those skilled in the art that further embodiments may be made without departing from the scope of the present invention.

What is claimed is:

1. A self-closing rail system, comprising:

a first rail having a first wall, a second wall, a third wall connected between the first and second walls and a first channel defined by the first, second and third walls, the first rail having a first end and a second end, a first assist member being pivotally connected to the first end of the first rail;

a second rail slidably connected to the first channel of the first rail, the second rail having a first wall, a second wall, a third wall connected between the first and second walls of the second rail and a second channel defined by the first, second and third walls of the second rail, the second rail having a first end and a second end, the first assist member rotatably supported by the second channel which is located corresponding to the first channel, a second assist member being pivotally connected to the second end of the second rail and rotatably supported by the first channel of the first rail; and a self-closing device coupled to the first rail, the self-closing device comprising:

a fixing member connected to the second rail, the fixing member including a pin connected thereto;

an attachment member connected to the first rail with the first rail extending longitudinally thereacross, the attachment member including a longitudinally directed guide portion extending laterally from a surface of the attachment member, the guide portion including a first guide end and a longitudinally spaced second guide end, the guide portion being upwardly inclined with respect to the first rail with the second guide end being higher than the first guide end;

a movable member movably connected to the guide portion of the attachment member, the movable member including a passage extending longitudinally thereacross defined by a support formed adjacent a first longitudinal end of the movable member and a pair of opposed supports formed adjacent an opposing second longitudinal end of the movable member, the guide portion being received in the passage for slidable engagement of the movable member thereon, the movable member includes a reception portion formed therein for releasable engagement with the pin of the fixing member; and, an elastic member connected between the attachment member and the movable member for applying a bias force to the movable member against longitudinal displacement thereof from the first guide end toward the second guide end;

wherein the movable member located at the first guide end of the guide portion and the pin engaged with the reception portion of the movable member when the second rail is in a retracted position relative to the first rail the movable member being slidably displaced along the guide portion against the bias force of the elastic member responsive to the second rail being moved away from the retracted position relative to the first rail;

wherein responsive to the movable member being slidably displaced to a position where the support adjacent the first longitudinal end thereof passes the second guide end of the guide portion, an angular movement of the movable member is generated to thereby release the pin from engagement with the reception portion of the movable member and retain the movable member thereat by the bias force of the elastic member, the second rail thereby being further displaceable in a direction from the retracted position without the bias force applied thereto, and responsive to the second rail being subsequently displaced relative to the first rail toward the retracted position and responsive to the pin contacting the movable member, the movable member rotates to release the support adjacent the first longitudinal end thereof from the second guide end, engage the reception portion with the pin, and the bias force of the elastic member displaces the movable member toward the first guide end of the guide portion to thereby retract the second rail relative to the first rail.

2. The self-closing rail system as claimed in claim 1, wherein the first and second walls on the second end of the first rail respectively have a first tilt surface, the second channel of the second rail has a second tilt surface close to the first end of the second rail, the second tilt surface is located corresponding to the first tilt surface of the first rail.

3. The self-closing rail system as claimed in claim 1, wherein the attachment member includes a first side which is located corresponding to the third wall of the first rail, a first plate extends from the first side of the attachment member and is located corresponding to the second wall of the first rail, the first plate has a first stop wall extending upward from a side thereof, a second plate extends from the first side of the attachment member and is located corresponding to the first wall of the first rail, the second plate has a second stop wall extends downward from a side thereof, and a third plate extends from the first side of the attachment member to engage with the first rail.

4. The self-closing rail system as claimed in claim 3, wherein the first rail includes a first connection portion which is located corresponding to the third plate of the attachment member, the third plate includes a flexible leg corresponding to the first connection portion of the first rail and a first stop is located at a distance from the flexible leg, a second stop extends from the first side of the attachment member, an engaging space is defined among the flexible leg, the first stop and the second stop, and the engaging space substantially has the same length as that of the first connection portion of the first rail.

5. The self-closing rail system as claimed in claim 3, wherein the first rail includes a first connection part which is located corresponding to the third plate of the attachment member, the third plate is a protrusion, and the first connection part is a hole with which the third plate is engaged.

6. The self-closing rail system as claimed in claim 1, further comprising a buffering member fixed to the attachment member, the buffering member including a retractable rod in contact with the movable member.

7. The self-closing rail system as claimed in claim 1, wherein the first and second walls of the second end of the first rail respectively include a first tilt surface, the second channel of the second rail has a second tilt surface close to the first end of the second rail, the second tilt surface is located corresponding to the first tilt surface of the first rail, the guide portion is located corresponding to the first and second tilt surfaces and includes an angle relative to a horizontal plane.

8. The self-closing rail system as claimed in claim 1, wherein the second rail includes a second connection portion which is a hole, the fixing member includes a first fixing portion and a second fixing portion, the first fixing portion is connected to the second connection portion of the second rail, and the second fixing portion is against the second rail.

9. The self-closing rail system as claimed in claim 8, wherein the first fixing portion includes a stepped engaging portion and the second connection portion includes a tab to which the stepped engaging portion is connected.

10. The self-closing rail system as claimed in claim 1, wherein the movable member includes an elastic portion is located at a first end of the reception portion, and an anchoring portion is located at a second end of the reception portion so as to be connected with an end of the elastic member.

11. The self-closing rail system as claimed in claim 1, wherein the attachment member of the self-closing device includes a first hole, a second hole and a protrusion, the third wall of the first rail includes a first protruding plate and a second protruding plate, the first and second protruding plates are engaged with the first and second holes, the third wall of the first rail includes an aperture with which the protrusion of the self-closing device is engaged, such that the first and second protruding plates are secured with the first and second holes.

12. The self-closing rail system as claimed in claim 1, wherein the first rail is fixed to a furniture article, a gap is defined between the first rail and the furniture article, the self-closing device is connected to the third wall of the first rail and located in the gap.

* * * * *